United States Patent [19]

Knepp et al.

[11] 4,243,537

[45] Jan. 6, 1981

[54] SYNTHETIC METAL WORKING LUBRICANT

[75] Inventors: James E. Knepp; William G. Johnston, both of Pittsburgh, Pa.; Myron J. Jursich, Chicago, Ill.

[73] Assignee: Aluminum Company of America, Pittsburgh, Pa.

[21] Appl. No.: 932,006

[22] Filed: Aug. 8, 1978

[51] Int. Cl.[3] ..... C10M 1/06; C10M 1/32

[52] U.S. Cl. ..... 252/49.3; 252/515 A

[58] Field of Search ..... 252/49.3

[56] References Cited

U.S. PATENT DOCUMENTS

| | | | |
|---|---|---|---|
| 2,951,041 | 8/1960 | Saunders | 252/51.5 A X |
| 3,371,171 | 3/1968 | Davis | 252/34.7 |
| 3,923,671 | 12/1975 | Knepp | 252/49.5 |

OTHER PUBLICATIONS

Union Carbide Corp., "UCON Metalworking Lubricants", pp. 1 to 4, F-45812B, 4/77.

*Primary Examiner*—Paul F. Shaver

*Attorney, Agent, or Firm*—David J. Hill; John P. Taylor

[57] ABSTRACT

A synthetic metal working lubricant characterized by an absence of mineral oil and dispersible in water comprises an alkanolamine such as triethanolamine, a 12 to 18 carbon aliphatic acid, such as oleic acid, and a water-dispersible or miscible polyoxyalkylene alcohol. The lubricant may optionally also contain an aliphatic carboxylic acid ester or diester. The resulting lubricant can be disposed of in accordance with existing EPA regulations on amounts of effluent extractable with hexane in comparison with prior art mineral oil based lubricants.

3 Claims, 1 Drawing Figure

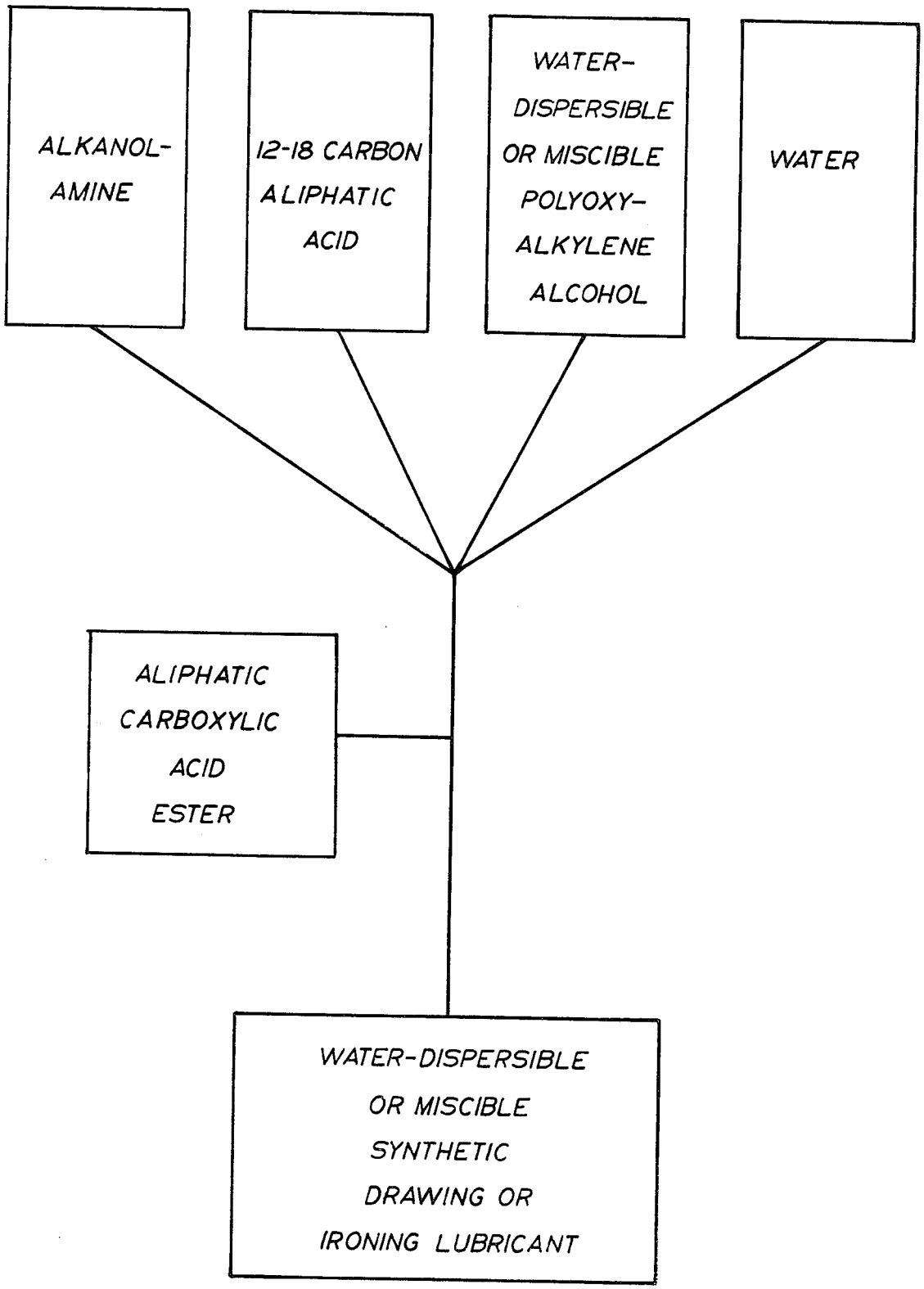
ALKANOL-AMINE
12-18 CARBON ALIPHATIC ACID
WATER-DISPERSIBLE OR MISCIBLE POLYOXY-ALKYLENE ALCOHOL
WATER
ALIPHATIC CARBOXYLIC ACID ESTER
WATER-DISPERSIBLE OR MISCIBLE SYNTHETIC DRAWING OR IRONING LUBRICANT

SYNTHETIC METAL WORKING LUBRICANT

BACKGROUND OF THE INVENTION

The use of synthetic lubricants has become the object of increased attention over the more conventional use of petroleum based lubricants. Single phase aqueous lubricants have not been extensively used successfully in such applications as drawing, ironing, rolling, extrusion, and similar metal forming processes. However, it has been customary to use certain ingredients found in synthetic lubricants such as, for example, oleic acid in connection with a mineral oil. For example, Knepp U.S. Pat. No. 3,923,671 discloses and claims a lubricant containing a fatty acid and mineral oil together with an aliphatic carboxylic acid ester and an emulsification agent. An emulsification agent is used to permit dispersion of the Knepp lubricant in water for use as a drawing and ironing lubricant in the can-making art.

It is also known to use alkanolamines and polyoxyalkylene glycols in aqueous lubricant composition. For example, Davis U.S. Pat. No. 3,374,171 discloses a cutting fluid comprising an alkanolamine, a polyoxyalkylene glycol and a saturated organic acid containing from 6 to 9 carbon atoms. Davis cautions, however, against the use of higher molecular weight saturated organic acids stating that the use of such higher organic acids can result in clogged filters, poor rust protection and reduced tool life in areas where hard water is encountered.

SUMMARY OF THE INVENTION

Quite surprisingly, however, it has been discovered that a synthetic lubricant having good lubricating properties in the fabrication of aluminum metal, particularly in the drawing and ironing of aluminum cans, can be obtained using an alkanolamine, a water-dispersible or miscible polyoxyalkylene alcohol and an aliphatic acid containing from 12 to 18 carbon atoms. A carboxylic acid ester or diester may also be used with the other ingredients. This combination of ingredients disperses or mixes in water to form a lubricant which has very low extractability in hexane. This provides a lubricant which will comply with existing EPA regulations on effluent disposal. In a preferred embodiment, an aliphatic carboxylic acid ester is also added.

BRIEF DESCRIPTION OF THE DRAWING

The sole drawing of the invention is a flow sheet showing the constituents of the novel lubricant.

DESCRIPTION OF THE INVENTION

In accordance with the invention, a synthetic lubricant is provided comprising an alkanolamine, a 12 to 18 carbon aliphatic acid and a water-dispersible or miscible polyoxyalkylene alcohol.

The alkanolamine may be a mono-, di-, or trialkanolamine wherein the alkanol moiety may have 2 to 4 carbon atoms such as ethanol, propanol, or butanol, e.g. triethanolamine.

The aliphatic acid containing from 12 to 18 carbon atoms may include both saturated, unsaturated, and branched chain acids and mixtures thereof. Suitable saturated and unsaturated acids include: lauric acid, myristic acid, palmitic acid, stearic acid, oleic acid, isostearic acid, linolenic acid, ricinoleic acid, etc. Preferably, the acid contains at least 16 carbon atoms.

The polyoxyalkylene alcohol is a water-dispersing or miscible ether alcohol which is the reaction product of an alcohol or phenol with alkylene oxides. The alcohol has the formula R-OH wherein R may be a 1 to 6 carbon alkyl or an aryl, including a substituted aryl. The polyether or polyalkylene oxide portion may comprise a polymer or ethylene oxide, propylene oxide, butylene oxide, or copolymers of combinations of any two or all three of the above. The alkylene oxide units in the ether may be from 2 to 20 in number. Examples of such polyoxyalkylene alcohols include Ucon 50HB5100, a butoxypolyoxyalkylene ethanol available from Union Carbide, Triton X-100, an isooctylphenylpolyethyloxy ethanol available from Rohm and Haas and Ucon 75H9500, a polyoxyalkylene ethanol available from Union Carbide. The polyoxyalkylene alcohol should be water soluble to obtain the desired single phase aqueous lubricant.

An optional additional ingredient is an aliphatic carboxylic acid ester or diester comprising the esterified product of monocarboxylic acids having at least 4 carbon atoms with monoalcohols or polyhydrics including polyhydric polyether alcohols. Examples of the monocarboxylic acids which may be used in the ester include butyric acid, caproic acid, caprylic acid, capric acid, lauric acid, myristic acid, and palmitic acid. Examples of the alcohols include methyl alcohol, ethyl alcohol, isopropyl alcohol, ethylene glycol, propylene glycol, glycerol, diethylene glycol, triethylene glycol, dipropylene glycol and tripropylene glycol. The acids which have been esterified with the alcohol may comprise only one acid or may be a mixture of acids. An example of such an ester is triethylene glycol caprate-caprylate.

In accordance with the invention, the alkanolamine should comprise from 5 to 15 parts by weight of the entire lubricant. The aliphatic acid should also comprise 5 to 15 parts by weight of the lubricant. The polyoxyalkylene alcohol should comprise from 10 to 55 parts by weight of the lubricant. The aliphatic carboxylic acid ester comprises from 0 to 20 parts by weight and the balance of the lubricant comprises water, i.e. from 15 to 40 parts. It should be noted here that the foregoing ratios provide the "neat" lubricant which then is further diluted with water in actual use to the extent of from 20% by weight neat lubricant down to as little as 2% neat lubricant. The purpose of the water in the neat lubricant formulation is to provide compatibility of the constituents into a single phase concentrate. The following examples will serve better to illustrate the invention.

EXAMPLE I

Two lubricants formulated in accordance with the invention were evaluated together with a commercially available lubricant as drawing lubricants in a blank and draw cupping press. Lubricant A contained (in parts by weight) 5 parts triethanolamine, 10 parts oleic acid, 50 parts Ucon 50HB5100 polyalkylene oxide alcohol and 35 parts water. Lubricant B contained (in parts by weight) 5 parts triethanolamine, 10 parts oleic acid, 50 parts Ucon 50HB5100, 15 parts triethylene glycol caprate-caprylate ester and 20 parts water. Lubricant C is a commercial drawing and ironing lubricant sold as XL-174 by Nalco Chemical Company. In each instance 16.5 mil can sheet made from Aluminum Association Alloy 3004 with H19 temper was used both for drawing and ironing. Table I indicates the performance of lubricants A, B and C as drawing lubricants.

TABLE I

| Lubricant | Concentration in Water | Tear Out Number of Failures in 300 Can | Sidewall Scuffing |
|---|---|---|---|
| A | 20% | 0 | None |
| A | 20%* | 0 | None |
| A | 10% | 0 | None |
| A | 5% | 0 | None |
| B | 20% | 0 | None |
| B | 20%* | 0 | None |
| B | 10% | 0 | None |
| B | 5% | 0 | None |
| C | 20% | 0 | None |
| C | 20%* | 0 | None |
| C | 10% | 0 | None |
| C | 5% | 0 | None |

*Can stock for these runs was cleaned to remove all residual rolling lubricants.

In each instance the lubricants performed satisfactorily during the drawing of 300 cans without any scuffing of the sidewalls of the cans or any fracturing of the can walls, either of which would indicate failure of the lubricant to provide a satisfactory lubricating film between the drawing punch and the aluminum sheet. It should be noted that the concentrations denote the addition of further amounts of water to the neat formula which already contains water.

EXAMPLE II

The same lubricants of Example I were also evaluated as ironing lubricants in a body-making press together with an additional commercially available synthetic ironing lubricant D. The lubricants were used on the same can stock as in Example I. To simulate actual commercial operating conditions, the ironing operation was done simultaneously with a drawing operation. In each instance, the lubricants performed significantly better as ironing lubricants when used in conjunction with the use of lubricant C as the drawing lubricant.

TABLE II

| Drawing Operation | | Ironing Operation | | | |
|---|---|---|---|---|---|
| Lubricant | Concentration | Lubricant | Concentration | Tear Out (Number per total cans ironed) | Sidewall Grade |
| C | 20% | C | 10% | 3/2200 | 3 |
| C | 20% | A | 5% | 1/2200 | −2 |
| A | 20% | A | 5% | 0/10 | −2 |
| A | 10% | A | 5% | 0/10 | −2 |
| B | 20% | B | 5% | 0/20 | −2 |
| C | 20% | B | 5% | 0/2000 | 2 |
| C | 20% | D | 5% | 1/100 | −2 |
| C | 20% | D* | 5% | 0/2000 | −2 |

*Punch was swirled with 120 grit paper to prevent buildup of aluminum metal on punch.

The sidewall grade is an arbitrary scale from 1 to 5 with the lowest number indicating the least amount of scratching or marking of the can sidewall. A minus indicates slightly lower grade than the number itself. In those instances where lubricants A or B were used in both drawing and ironing, the ironing was stopped after 10 or 20 cans, respectively, due to aluminum metal buildup on the ironing punch. It must be noted that the use of lubricant C in both ironing and drawing stages did not produce as good sidewall grading as when the lubricants of the invention were used in the ironing step.

Having thus described the invention, what is claimed is:

1. A synthetic lubricant for metal working dispersible or miscible in water comprising:
   (a) 5 to 15 parts by weight triethanolamine;
   (b) 5 to 15 parts by weight 16 to 18 carbon atom aliphatic acid;
   (c) 10 to 55 parts by weight polyoxyalkylene alcohol and dihydric alcohols;
   (d) an aliphatic carboxylic acid ester in amount not more than 20 parts by weight; and
   (e) 10 to 35 parts by weight water.

2. A synthetic metal working lubricant characterized by an absence of mineral oil and dispersible or miscible in water which comprises:
   (a) 5 to 15 parts by weight alkanolamine;
   (b) 5 to 15 parts by weight 12 to 18 carbon atom aliphatic acid;
   (c) 10 to 55 parts by weight polyoxyalkylene alcohol;
   (d) 10 to 35 parts by weight water; and
   (e) 10 to 20 parts by weight of an aliphatic carboxylic acid ester.

3. The lubricant of claim 1 wherein further water is added to provide an additional 8 to 9 parts by weight water per part by weight lubricant.

* * * * *